United States Patent [19]

Conner et al.

[11] 4,214,199

[45] Jul. 22, 1980

[54] CURRENT TRANSFORMER

[75] Inventors: Edmond E. Conner, Brookfield, Ohio; Edward C. Wentz, Hickory, Pa.

[73] Assignee: Westinghouse Electric Corp., Pittsburgh, Pa.

[21] Appl. No.: 881,475

[22] Filed: Feb. 27, 1978

[51] Int. Cl.[2] ..... G05F 3/00

[52] U.S. Cl. ..... 323/6; 323/60; 324/126

[58] Field of Search ..... 323/6, 44 R, 50, 60, 323/88; 336/173; 324/126–127; 361/93

[56] References Cited

U.S. PATENT DOCUMENTS

| | | | |
|---|---|---|---|
| 1,640,554 | 8/1927 | Peters | 324/127 |
| 1,731,865 | 10/1929 | Pfiffner | 323/50 |
| 1,863,936 | 6/1932 | Schwager | 323/60 |
| 1,865,430 | 7/1932 | Borkent | 340/31 R |
| 1,866,345 | 7/1932 | Callsen | 323/60 |
| 1,914,395 | 6/1933 | Austin | 323/8 |
| 2,129,524 | 9/1938 | Camilli | 323/60 |
| 3,532,964 | 10/1970 | Marks | 323/60 |
| 3,775,722 | 11/1973 | Wentz et al. | 336/217 X |
| 3,881,149 | 4/1975 | Kiko | 323/6 |
| 4,140,961 | 2/1979 | Akamatsu | 323/6 |

*Primary Examiner*—J. D. Miller
*Assistant Examiner*—Peter S. Wong
*Attorney, Agent, or Firm*—D. R. Lackey

[57] ABSTRACT

A high-voltage current transformer has an external inductance element electrically connected thereto. The inductance element has a relatively low magnitude of inductance, compared with the inductance of the current transformer, to cause a substantial increase in the excitation current which significantly reduces the residual flux in the current transformer.

6 Claims, 7 Drawing Figures

CURRENT TRANSFORMER

BACKGROUND OF THE INVENTION

1. Field of the Invention

This invention relates, in general, to electrical inductive apparatus and, more specifically, to high-voltage current transformers.

2. Description of the Prior Art

Instrument transformers are used to monitor voltages and currents existing in power transmission and distribution systems. Current-type instrument transformers, or current transformers, usually include a magnetic core structure having a winding disposed thereon. The magnetic core and winding assembly are suitably placed in the magnetic field created by the current to be measured. A change in the measured current produces a change in the surrounding flux; thus the voltage induced in the winding of the current transformer is changed.

Current transformers are used to provide a variety of functions, including metering and relaying. The output from the current transformer must be sufficiently representative of the measured current in order to provide the proper metering or relaying action.

The current being measured may be interrupted at any point during the polarity cycle; therefore, the possibility of creating a residual flux in the magnetic core of the current transformer is great. When using conventional core materials and construction arrangements, the residual flux may be as high as 90% of the peak flux during normal operation.

Residual flux may present errors or incorrect control of the components and circuits connected to the current transformer. When the current being measured begins to flow after a period during which the current did not flow, such as after a fault, the flux provided by the flowing current is added vectorially to the residual flux which could result in an incorrect current transformer output.

The residual flux is reduced to a nominal value after several cycles of alternating flux have been induced in the magnetic core. With the advent of metering and relaying components which respond quickly and the desirability of using these components in the first few cycles following a fault, the instantaneous response of current transformers is becoming more important.

One conventional method of reducing the residual flux in current transformers in order to provide instantaneous action utilizes air gaps in the magnetic core of such devices, as shown in U.S. Pat. No. 3,775,722 which is assigned to the assignee of the present application. As described therein, the magnetic core includes a relatively small gap which is filled with solid insulating material to maintain the spacing between adjacent layers of core laminations.

Unfortunately, reducing residual flux by constructing an air gap in the magnetic core of the current transformer increases the field intensity required to produce a given amount of flux density. To keep the flux density and field intensity relationships of the magnetic core within usable limits, the effective air gap must be kept as small as possible while still providing a significant reduction in the maximum residual flux. Although satisfactory for certain current transformer applications, such as bushing-type current transformers, the use of gapped magnetic cores in other types of current transformers, such as extra high voltage wound-type current transformers, has proved to be uneconomical and unreliable due to difficulty in maintaining gap tolerances.

Thus, it is desirable to provide a current transformer which exhibits relatively low residual flux components. It is also desirable to provide a current transformer which includes economical means for reducing residual flux components. Finally, it is desirable to provide a current transformer having reduced residual flux components in which closer control of the magnetizing characteristics is obtained compared with gapped magnetic core constructions.

Since the permeability of the magnetic cores commonly used in current transformers and, therefore, the magnetizing current in the primary winding varies with the load, the magnetizing current increases less rapidly than the voltage across the primary winding, thereby causing the ratio between the primary and secondary currents to also vary with the load. Many different arrangements have been utilized to maintain a constant ratio between the primary and secondary currents over the load range of the current transformer and for correcting phase angle differences due to varying loads.

U.S. Pat. No. 3,532,964 disclosed a current transformer construction wherein impedance elements are connected across the secondary winding to correct phase angle errors due to varying loads. Similarly, non-linear impedance elements, such as a non-linear resistor in U.S. Pat. No. 2,129,524 and a non-linear magnetic core reactor in U.S. Pat. No. 1,863,936, have been connected in parallel with the secondary winding such that the vector sum of the exciting current through the impedance element plus the exciting current through the magnetic core of the current transformer will increase linearly with the flux in the magnetic core and thereby maintain a constant ratio between the primary and secondary currents.

Although such configurations satisfactorily correct ratio and phase angle errors in current transformers, they do not significantly reduce residual flux components to levels necessary for instantaneous relaying applications. As is well known to those skilled in the art, the introduction of an impedance into the equivalent circuit of a current transformer, such as by the use of an air gap in the magnetic core, will shift the magnetization curve of the current transformer such that it intercepts the zero field intensity ordinate at a lower point than without the additional impedance. The amount of shift of the magnetization curve is proportional to the exciting current, with higher exciting currents causing greater amounts of shift and, accordingly, less residual flux components.

However, the use of additional impedances to correct ratio and phase angle errors, as shown in U.S. Pat. No. 2,129,524 and No. 1,863,936, requires substantial impedance values which have the opposite effect insofar as reducing residual flux components since higher impedances result in smaller total reactor currents compared to gapped magnetic core devices and, therefore, cause less of a reduction of a residual flux in the magnetic core of the current transformer.

What is needed is a substantially low impedance which will create a higher total reactor current for a given amount of magnetizing flux and will thereby significantly reduce residual flux components to levels required for instantaneous relaying applications.

SUMMARY OF THE INVENTION

There is disclosed herein a new and improved current transformer suitable for use in relaying applications which economically provides the same low levels of residual flux as current transformers utilizing gapped magnetic cores without the manufacturing tolerance problems associated with such devices. The novel current transformer of this invention includes an inductance element which is electrically connected to the current transformer. The inductance element has a significantly lower inductance value than the inductance of the current transformer which results in a substantially higher current through the inductance element such that the total current flow due to the magnetic core of the current transformer and the inductance element is increased to such an extent that the residual flux in the magnetic core of the current transformer is reduced from 90% of the peak flux to approximately 10% of the peak flux, which is more acceptable for instantaneous relaying applications.

In one embodiment, the inductance element is an electrical reactor having a gapped magnetic core which provides linear magnetization characteristics with respect to voltage changes such that the ratio errors in the current transformer are held to acceptable levels. A gapped magnetic core electrical reactor may be constructed more economically than the gapped magnetic core current transformer and, further, eliminates the manufacturing tolerance problems associated with the use of gapped magnetic cores in the substantially larger high-voltage current transformers.

In another embodiment of this invention the inductance element comprises an air core reactor. Since the air core reactor contains no magnetic material, its magnetization characteristics are also linear which, again, minimizes ratio errors in the current transformer.

Although electrical reactors having structures similar to that described herein have been utilized previously in conjunction with current transformers, such devices have been intended for an entirely different function, namely to control or correct ratio and phase angle errors in the current transformer. In order to control such errors, the inductance values of the reactors must be extremely high compared with the inductance of the magnetic core of the current transformer in order to minimize the losses due to the exciting current in the current transformer. The novel current transformer described herein utilizes the magnetization characteristics of an inductance element, such as an electrical reactor, in a unique relationship with the current transformer in order to substantially reduce the residual flux in the current transformer to levels acceptable for instantaneous relaying applications.

BRIEF DESCRIPTION OF THE DRAWING

The various features, advantages and other uses of this invention will become more apparent by referring to the following detailed description and drawing in which.

DESCRIPTION OF THE PREFERRED EMBODIMENTS

Figure 1:
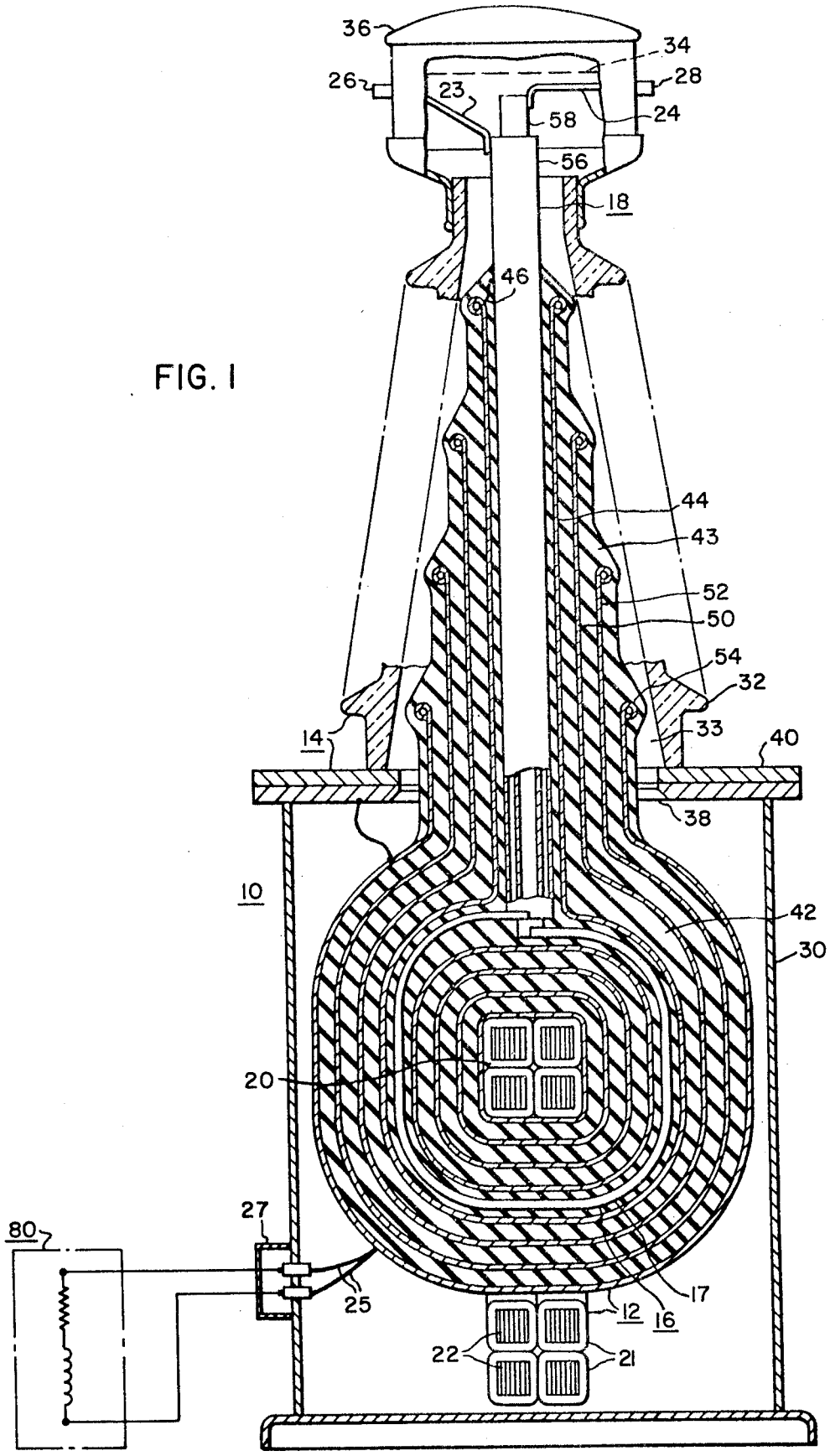
FIG. 1 is an elevational view, partially in section, of a current transformer which may use the teachings of this invention.

Throughout the following discussion, identical reference numbers are used to refer to the same component shown in all Figures of the drawing.

Referring now to the drawing, and to FIG. 1 in particular, there is illustrated an elevational view, partially in section, of a high-voltage current transformer 10 constructed according to the teachings of this invention. The current transformer 10 includes a core and winding assembly 12 which is disposed within a suitable housing 14. The core and winding assembly 12 includes a high-voltage winding assembly 16 and a low-voltage winding assembly 20 which are disposed in inductive relation with a magnetic core means 22. The low-voltage winding assembly 20 may include one or more separate windings 21, each disposed in inductive relation with a magnetic core member 22, with the number of winding and core members depending upon the requirements of the particular application the current transformer 10 is to be utilized with. For example, FIG. 1 illustrates a low-voltage winding assembly 20 having four low-voltage windings 21 and four magnetic core members 22. Electrical leads 25 extend from the low-voltage winding assembly 20 to a suitable terminal box 27 disposed on the enclosure or housing 14.

The high-voltage winding assembly 16 includes high-voltage winding section 17 and lead assembly 18, with the lead assembly 18 extending upwardly from the high-voltage winding section 17 to be electrically connected to terminals 26 and 28 through electrical conductors 23 and 24, respectively. Terminals 26 and 28 are adapted for connection to an alternating current power system whose current is to be measured or sensed.

The housing 14 includes a tank 30 for containing the high and low voltage winding assemblies 16 and 20, respectively, and a hollow cylindrical porcelain bushing or outdoor weather housing 32 having a central opening 33 that is tapered in cross section along its vertical axis for enclosing the high-voltage lead assembly 18. The tank 30 has an opening 38 disposed in its top or upper portion 40. The bushing 32 is disposed in sealed engagement with the top portion 40 of the tank 30 with its vertical axis substantially perpendicular thereto; and with the opening 33 in the bushing 32 being in registry or in alignment with the opening 38 in the top 40 of the tank 30. The tank 30 and bushing 32 are filled to a level indicated at line 34 with a suitable fluid dielectric, such as mineral oil, for cooling and insulating the transformer 10. An expansion cap 36 is disposed at the top of bushing 32 to allow for expansion and contraction of the fluid dielectric as the thermal condition of the current transformer 10 changes during normal operation.

The low-voltage winding assembly 20 is disposed inside the high-voltage winding assembly 16. In order to insulate the high voltage winding section 17 from the low-voltage winding assembly 20 and from the grounded portions of the transformer housing, such as the tank 30, solid insulation 42 is disposed to surround the high-voltage winding section 17. The solid insulation 42 may be any suitable insulating material, such as crepe paper, in sheet or tape form, which is either taped, wrapped or folded around the high-voltage winding section 17 and between the high-voltage winding section 17 and the low-voltage winding assembly 20.

In order to electrically insulate the high-voltage lead assembly 18 from the grounded portion of the transformer housing 14, such as the portion of the tank 30 which surrounds the opening 38, solid insulation 43 is disposed to substantially surround at least the major vertical portions of the lead assembly 18. The solid insulation 43 may be similar to the solid insulation 42 surrounding the high-voltage winding section 17, and may be crepe paper in flexible sheet form which is taped, wrapped or folded around the lead assembly 18. The thickness of the solid insulation 43 is generally tapered from a maximum value at the lower portion of the lead assembly 18 to a minimum value near the upper portion of the lead assembly 18. The entire solid insulation structure may be oil impregnated using high-vacuum techniques.

In order to reduce the concentration of dielectric stress in the solid insulation 42 surrounding the high-voltage winding section 17, particularly adjacent to the outer ends or corners of said high-voltage winding section 17 and in the solid insulation 43 surrounding the lead assembly 18, inner shielding members 44, 50, 52 and 54 are disposed to substantially surround the high-voltage winding section 17 and the major portion of the lead assembly 18. The upper portion of the inner shields 44, 50, 52 and 54 may be formed by tightly winding a flexible conducting material having a layer of insulation secured thereto, such as crepe paper-backed metallic foil, in the form of a sheet or tape substantially around the lead assembly 18 at a predetermined point in the build of the solid insulation 43.

The upper end of one of the inner shielding members, such as shielding member 44, is electrically connected to the lead assembly 18 by electrical conductor 46 in order for the shielding members to provide a substantially equal potential surface around the high voltage winding section 17 and the high-voltage lead assembly 18, which is substantially at the same potential as the high-voltage winding 17, to thereby substantially eliminate any potential stress to which the fluid dielectric inside of the lead assembly 18 is subjected.

As shown in FIG. 1, the high-voltage lead assembly 18 includes two electrically conductive tubular members 56 and 58 which are connected to the ends of the high-voltage winding section 17 and which extend vertically upward therefrom through opening 38 in the tank 30, through opening 33 in the bushing member 32 and into the expansion cap 36. The diameter and wall thickness of the tubular members 56 and 58 are selected to allow tubular member 56 to be telescoped over tubular member 58 such that the tubular members 56 and 58 are concentrically aligned about a common vertical axis to form a fluid flow path therebetween. Electrical conductor 23 connects the outer tubular lead conductor 56 to terminal 26 and electrical conductor 24 connects the inner lead conductor 58 to terminal 28. The other ends of the tubular lead conductors 56 and 58 are respectively connected to opposing ends of the high-voltage winding section 17 which is formed of a single conductive member having a channel or grooves therein for coolant flow.

Although the above-described current transformer structure has been illustrated for use with the teachings of this invention, other structures or configurations of current transformers may be used as well.

Before proceeding with a detailed description of the novel means for reducing residual flux components in the current transformer, a brief explanation of the theory behind the operation of such apparatus will be presented for a better understanding of the teachings of this invention.

Figure 2:
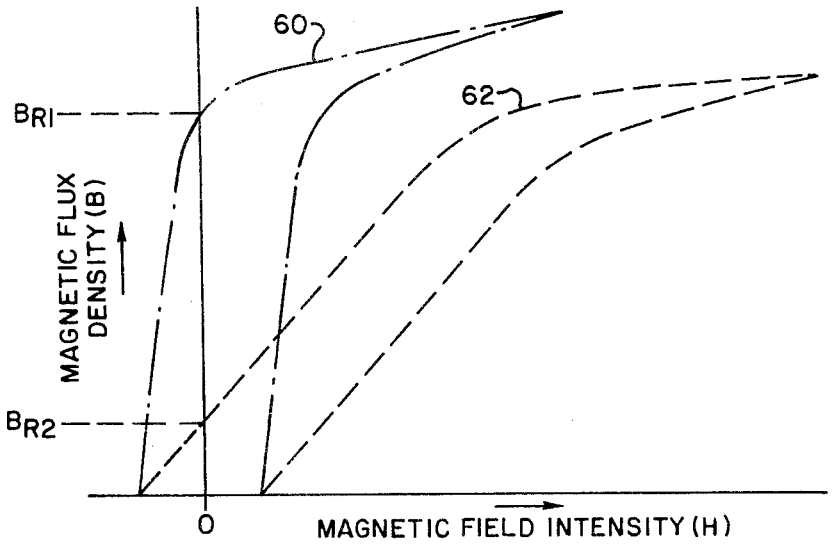
FIG. 2 is a graph illustrating magnetization curves for the current transformer shown in FIG. 1.

FIG. 2 illustrates the upper portion of magnitization, or B-H, curves for magnetic cores, such as the magnetic core 22 used in the current transformer 10 shown in FIG. 1. Curve 60 is representative of a typical magnetic core. When the field intensity decreases to zero, and remains at zero, the residual flux $B_{R1}$ in the core may be as high as 90% of the peak flux. In relaying applications where it is desirable to relay in the first few cycles following a system fault, this high level of residual flux in the magnetic core of a current transformer poses significant problems. Upon energization of the current transformer following a system fault, the flux may swing towards saturation which, in the case illustrated by curve 60, may result in a high exciting current and low output which, accordingly, introduces errors into the relaying operation. Thus, it is desirable to reduce the residual flux in the magnetic cores of current transformers to a significantly lower level, such as approximately 10% of the peak flux.

Curve 62 is representative of a magnetic core having a more desirable magnetization characteristic in which the magnetic flux density or residual flux $B_{R2}$ in the magnetic core of the current transformer when the field intensity decreases to zero is significantly reduced compared to curve 60. In order to reduce the residual flux to a significantly lower amount, as indicated by curve 62, means must be employed to shift or tilt the magnetization curve of the magnetic core of the current transformer. The amount of shift or tilt of the magnetization curve is proportional to the magnitude of the exciting current required by the current transformer, with higher exciting current causing a greater amount of shift of the magnetization curve.

Figure 3:
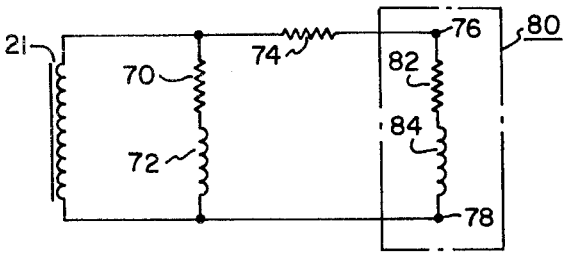
FIG. 3 is a schematic diagram of the equivalent circuit of a current transformer constructed according to the teachings of this invention.
Figure 4:
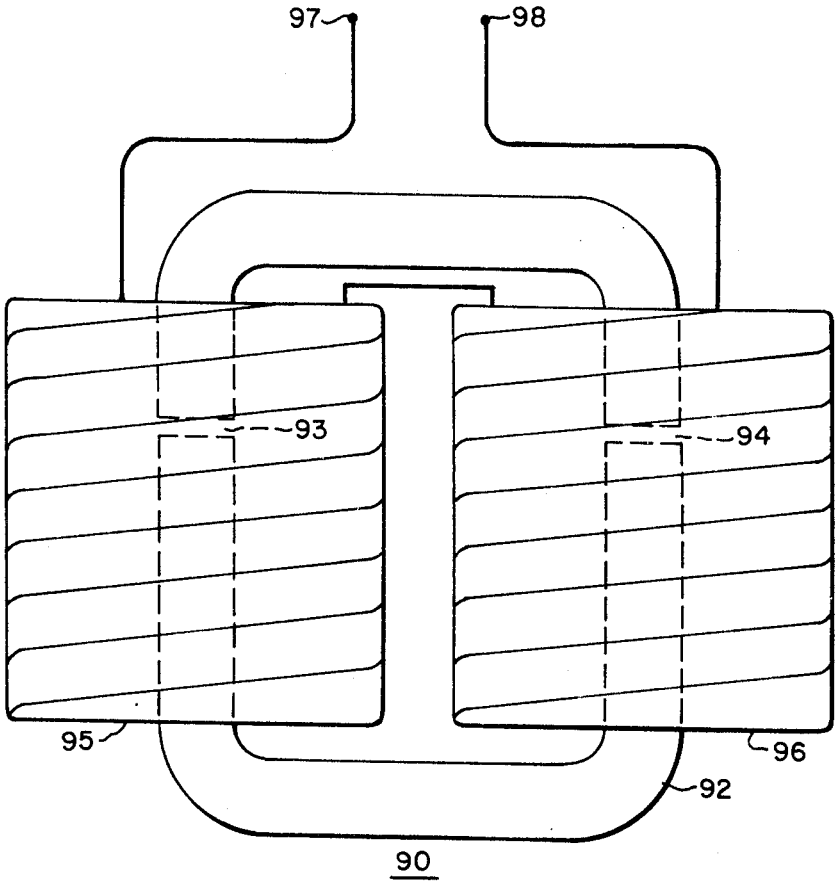
FIG. 4 is a view of a gapped magnetic core reactor suitable for use with the current transformer shown in FIG. 1.
Figure 5:
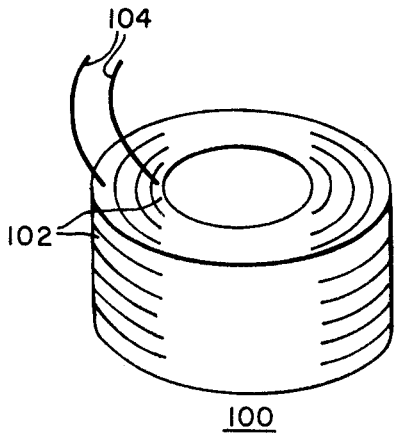
FIG. 5 is a perspective view of an air core reactor suitable for use with the current transformer shown in FIG. 1.

FIGS. 3, 4 and 5 illustrate means, constructed according to the teachings of this invention, which shift or tilt the magnetization curve the magnetic core of a current transformer in order to significantly reduce the residual flux therein. FIG. 3 depicts the equivalent electrical circuit of the secondary or low-voltage side of the current transformer 10 shown in FIG. 1. As shown therein, the impedance of the magnetic core of the current transformer 10 includes a resistance 70 and an inductance 72 which are shown in parallel with the secondary winding 21 of the current transformer 10. In addition, the secondary winding 21 has a resistance component which is shown by resistance element 74 connected in series therewith. The resistance and inductance elements 70 and 72 create the flow of exciting current in the magnetic core of the current transformer 10 which produces the magnetizing flux therein.

Figure 3A:
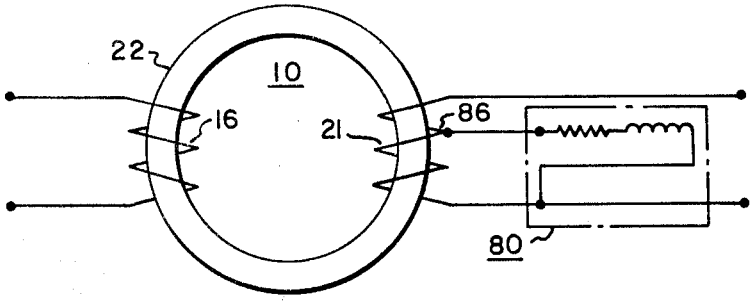
FIGS. 3A and 3B are schematic diagrams of other embodiments of a current transformer constructed according to the teachings of this invention.
Figure 3B:
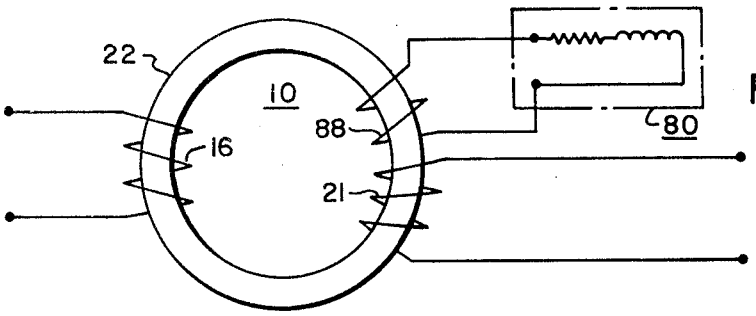

As described previously, in order to shift the magnetization curve of the magnetic core of the current transformer and thereby reduce the residual flux, it is necessary to increase the exciting current. This invention proposes to reduce the residual flux in the magnetic core of a current transformer by utilizing an inductance element which is electrically connected to the current transformer. The inductance element 80 may be connected in parallel or across the full number of turns of the low-voltage winding 21 of the current transformer 10 as shown in FIGS. 1 and 3. Equivalent results may also be obtained by connecting the inductance element 80 across a tapped portion 86 of the secondary winding 21, as shown in FIG. 3A, or across an auxiliary winding 88 which is inductively coupled to the magnetic core 22 of the current transformer 10, as shown in FIG. 3B. Referring again to FIG. 3, it can be seen that the inductance element 80 comprises a finite resistance 82 and an inductance 84. Since the resistances 70, 74 and 82 are small in comparison to the inductance values of magnetic devices, for the purposes of the following discussion, these resistance elements will be neglected and the equivalent circuit of the current transformer 10 will be described in terms of pure inductances only.

The addition of an inductance element, such as inductance element 80, in parallel with the magnetic core 22 of the current transformer 10 increases the total current, hereafter referred to as reactor current, flowing through the parallel circuit formed by the inductance elements 72 and 84 shown in FIG. 3. However, the higher the magnitude of the inductance element connected in parallel with the magnetic core 22, the less current will flow therethrough and, accordingly, a smaller amount of total current will flow through the parallel circuit formed by these inductance elements. In the prior art configurations which connect an inductance element across low-voltage winding of a current transformer to correct ratio errors, the value of the inductances used must necessarily be high in comparison to the magnitude of the inductance of the current transformer 10 in order to minimize the amount of exciting current and thereby reduce losses in the current transformer. This has an opposite effect in reducing the residual flux in the magnetic core of the current transformer since the total reactor current must be maximized in order to significantly shift the magnetization curve of the magnetic core and thereby substantially reduce the residual flux. Thus, it is critical to utilize an inductance element having a magnitude significantly smaller than the magnitude of the inductance of the magnetic core and windings of the current transformer in order to significantly reduce the residual flux therein. It has been found that the use of an inductance element having a magnitude approximately one-half of that of the magnetic core/winding assembly results in a current flow therethrough which is twice the current flow due to the magnetic core of the current transformer and which, accordingly, results in a total current flow through the equivalent parallel circuit formed by the inductance element and the magnetic core of the current transformer three times that normally drawn due to the magnetic core of the current transformer alone. For example, a typical current transformer for relaying applications would be rated at 345 kV, 2000:5 amps. At a specific operating voltage, i.e. 664 volts, the exciting current will be 0.081 amps which results in an exciting reactance of 8177 ohms for the magnetic core of the current transformer. An inductance element having a reacttance of 4,000 ohms would draw 0.162 amps when connected in parallel with the secondary winding of the current transformer. Thus, the total reactor current ($0.081+0.162=0.243$) is three times that of the current transformer exciting current alone. The tripling of the total current shifts the magnetization curve of the magnetic core of the current transformer to such an extent that the residual flux contained therein is reduced to approximately 10% of the peak flux which results in satisfactory operation of the current transformer in instantaneous relaying applications.

According to the teachings of this invention, the inductance element 80 is an electrical reactor which is disposed in inductive relation with the magnetic core 22 of the current transformer 10. The electrical reactor may be connected across the full number of turns of the secondary winding 21 of the current transformer 10, as shown in FIGS. 1 and 3, it may be connected across a tapped portion of the secondary winding 21, as illustrated in FIG. 3A, or it may be connected across an auxiliary winding, such as auxiliary winding 88 shown in FIG. 3B. Since all magnetic materials have non-linear magnetization characteristics, that is, the permeability of the magnetic material varies with the applied voltage, the use of such magnetic material in current transformers introduces significant errors in the ratio between the primary and secondary currents. Since the preferred embodiment of this invention proposes to substantially increase the total exciting current of the current transformer 10 in order to significantly reduce the residual flux in the magnetic core 22, the magnitude of ratio errors will also be increased. Thus, it is necessary to balance the reduction of residual flux in the magnetic core of a current transformer against the amount of increased errors in the current transformer. In relaying applications, a 10% ratio error between the primary and second currents is generally acceptable. If the inductance element which is connected across the low-voltage winding of the current transformer has linear magnetization characteristics, that is, its reactance varies linearly with changes in the applied voltage, it is possible to maintain the amount of ratio errors and the amount of residual flux in the magnetic core of the current transformer at acceptable levels for relaying applications.

Referring now to FIG. 4, there is shown an electrical reactor 90 constructed according to the teachings of this invention which significantly reduces the residual flux in the magnetic core 22 of the transformer 10 and, also, provides linear magnetization characteristics such that ratio errors are maintained at reasonable levels. The electrical reactor 90 includes a magnetic core 92 formed of a plurality of laminations of magnetic material. The magnetic core 92 includes air gaps 93 and 94 therein which may be formed by inserting solid insulating material between adjacent portions of the laminations of the magnetic core 92. It is possible to design the magnetic core 92 of the electrical reactor 90 such that the reactance of the air gaps 93 and 94 are significantly higher than the reactance of the magnetic material forming the laminations of the magnetic core 92 which provides the desired linear magnetization characteristics described above. In high-voltage current transformer applications, the size of the electrical reactor 90 will be relatively small which simplifies the construction of the air gaps 93 and 94 therein and eliminates the manufacturing tolerance problems associated with the use of magnetic cores in high-voltage current transformers. Electrical windings 95 and 96 are inductively coupled to the magnetic core 92 and include terminals 97 and 98 to connect the electrical reactor 90 across the low-voltage winding 21 of the current transformer 10 as described above.

FIG. 5 illustrates another embodiment of this invention wherein the inductance element 80 which is connected to the current transformer 10 consists of an air core reactor 100. The air core reactor 100 includes a plurality of turns 102 of an electrical conductor, having central openings therein, which are coaxially disposed about a common axis. As is well known to those skilled in the art, non-magnetic material may be disposed in the central opening of the conductor turns 102 in order to maintain the integrity of the air core reactor 100. In actual use, the air core reactor 100 is connected to the current transformer 10 by leads 104 and may be disposed within the tank or enclosure of the electrical apparatus associated with the current transformer 10. Since the air core reactor 100 contains no magnetic material, the inductance of the conductor turns 102 provides linear magnetization characteristics which in addition to substantially reducing the amount of residual flux in the magnetic core 22 of the current transformer 10, also lowers ratio errors in the current transformer 10 to acceptable levels.

As with the gapped magnetic core reactor 90, the air core reactor 100 may be connected across the full number of turns of the secondary winding, across an auxiliary winding inductively coupled to the magnetic core of the current transformer or across a tapped portion of the secondary winding. With either type of reactor, the connecting of the reactor to a tapped portion of the secondary winding enables the reactor to be designed for a more convenient value of current or voltage.

In summary, there has been disclosed herein a new and improved current transformer having significantly reduced residual flux components which makes it suitable for instantaneous relaying applications. An inductance element, which may be either a gapped magnetic core electrical reactor or an air core reactor, is connected to the current transformer. The inductance element has a significantly lower inductance value than the inductance of the current transformer, which results in an increase in the total reactor current to such a magnitude that the residual flux in the magnetic core of the current transformer is reduced to approximately 10% of the peak flux. The use of a gapped magnetic core electrical reactor or, alternately, an air core reactor, having linear magnetization characteristics also maintains the ratio errors of the current transformer at acceptable levels for relaying applications. The use of the gapped magnetic core electrical reactor or of the air core reactor also provides an economical means for reducing the residual flux in the magnetic core of the current transformer compared with prior art type of current transformers having gapped magnetic cores. In addition, the manufacturing tolerance problems associated with the use of gapped magnetic cores in current transformers are eliminated, which, therefore, improves the reliability of the current transformer.

What is claimed is:

1. A current transformer for monitoring the current flowing in an electrical circuit of an electrical power transmission and distribution system, comprising:

a magnetic core;

first and second windings disposed in inductive relation with said magnetic core;

said first winding being adapted to be energized by the current flowing in the electrical circuit of the electrical power transmission and distribution system, said second winding having a plurality of conductor turns, an inductance element including a winding having terminals, with the terminals being directly connected to said second winding to connect the winding of said inductance element across at least certain of the conductor turns of said second winding, said inductance element having a substantially linear voltage versus excitation current characteristic, and an inductance which is less than the inductance of said second winding, to increase the total excitation current required to magnetize said magnetic core and reduce the residual flux in said magnetic core when the magnetic field intensity is reduced to zero.

2. The current transformer of claim 1 wherein the inductance element has an inductance magnitude approximately one-half of the inductance magnitude of the second winding of the current transformer.

3. The current transformer of claim 1 wherein the magnetic core is devoid of non-magnetic gaps, and wherein the inductance element includes a magnetic core having at least one non-magnetic gap disposed therein.

4. The current transformer of claim 1 wherein the inductance element is an air core reactor.

5. The current transformer of claim 1 wherein the first and second windings are the primary and secondary windings, respectively, of the current transformer, with the second winding including output terminals.

6. The current transformer of claim 1 including a third winding having output terminals disposed in inductive relation with the magnetic core, with the first and third windings being primary and secondary windings, respectively, of the current transformer, and wherein the second winding is an auxiliary winding which is connected only to the winding of the inductance device.

* * * * *